United States Patent [19]

Nelson

[11] 4,059,873

[45] Nov. 29, 1977

[54] FLUID PROCESS FOR MAKING CONTINUOUS FILAMENT HEATHER YARN

[75] Inventor: Thomas Larson Nelson, Georgetown, Del.

[73] Assignee: E. I. Du Pont de Nemours and Company, Wilmington, Del.

[21] Appl. No.: 738,168

[22] Filed: Nov. 2, 1976

Related U.S. Application Data

[62] Division of Ser. No. 609,010, Aug. 29, 1975, abandoned.

[51] Int. Cl.[2] ..... D02G 1/16; D02J 1/08

[52] U.S. Cl. ..... 28/271

[58] Field of Search ..... 28/72.12, 1.4, 271, 28/72.11; 428/364, 369; 57/140 BY, 140 W

[56] References Cited

U.S. PATENT DOCUMENTS

| | | | |
|---|---|---|---|
| 3,501,819 | 3/1970 | Satterwhite | 28/72.11 X |
| 3,611,698 | 10/1971 | Horn | 28/72.12 X |
| 3,811,263 | 5/1974 | Newton | 28/72.12 X |
| 3,886,636 | 6/1975 | Borenstein et al. | 28/72.11 |
| 3,892,020 | 7/1975 | Koslowski | 28/72.12 |

*Primary Examiner*—Louis K. Rimrodt

[57] ABSTRACT

A twist-free continuous filament heather yarn of reduced streakiness and chevroning and muter appearance of the colors of the yarn making up the heather yarn when formed into a fabric is prepared by tensioning a plurality of twist-free crimped continuous filament yarns having a different color and/or dye receptivity in order to remove intra-yarn entanglement, passing the tensioned yarns side-by-side into a jet intermingling zone at a slower withdrawal rate from said zone. The heather yarn is characterized by substantially no twist between the yarns making up the heather yarn and by yarn-to-yarn randomly intermingled filaments forming blended areas of random length of filaments along the heather yarn randomly interspersed between unblended areas of random length along the yarn. The heather yarn is incorporated into a pile fabric.

10 Claims, 10 Drawing Figures

FLUID PROCESS FOR MAKING CONTINUOUS FILAMENT HEATHER YARN

CROSS-REFERENCE TO RELATED APPLICATION

This application is a division of my copending application Ser. No. 609,010 filed Aug. 29, 1975, and now abandoned.

BACKGROUND OF THE INVENTION

1. Field of the Invention

This invention relates to a heather yarn made of bulked continuous filament yarns having different color and/or dye receptivity and to a process for making such heather yarn.

2. Description of the Prior Art

A continuous filament heather yarn is a yarn consisting of a multiplicity of continuous filaments which are either of different color and/or have a different dye receptivity so that they are capable of being dyed to different colors. The effect of the heather yarn when colored and incorporated into a pile fabric is to display the color of the filaments primarily at the tip of the loop in the pile whether the loop is intact or is cut. The color of the pile fabric then takes on the appearance of the colors appearing at the top of each loop of the heather yarn making up the fabric.

Continuous filament heather yarns have suffered from the disadvantage that the color present at the top of the loops is either (a) the same or very similar color, whereby the pile fabric has the appearance of being made from a single colored yarn as a result of too complete blending of the different colored filament, or (b) too contrasty, i.e., too bold or flashy, which means it is predominantly the colors of the yarns making up the heather yarn that is seen at the tip of the loop in the pile fabric, to give the pile fabric a salt and pepper appearance.

Continuous filament heather yarns of the type (a) are disclosed in Reese, U.S. Pat. No. 3,593,513, wherein filaments of different dye receptivity are co-spun, and continuous filament heather yarns of the type (b) are disclosed in the references to be discussed hereinafter.

U.S. Pat. No. 3,534,540 to Collingwood discloses the making of a heather yarn by the simultaneous crimping of at least two continuous filament yarns having different color or dye receptivity, followed by entangling the crimped filaments and twisting the resultant assemblage to a level of 0 to 2 turns per inch. Unfortunately, the resultant heather yarn when untwisted consists primarily of the component yarns in parallel side-by-side relationship, i.e., the color of one component yarn or the color of the other component yarn predominates, depending on which side of the heather yarn is viewed. Such a heather yarn when incorporated into a pile fabric is too bold in that it is the colors of the component yarns that are primarily seen at the tops of the loops making up the pile. This is seen by reference to Table III of the patent which discloses that only as the twist of the heather yarn increases from 0 to 1.5 turns per inch does the heather increase from not being noticeable to a strong heather. The use of twist in a heather yarn has the effect of breaking up the parallel side-by-side registry of the colored component yarns so that there is a greater opportunity for a different component yarn color to be present at the top of adjacent loops in the pile fabric made from the yarn. The use of twist, however, to accomplish this result gives rise to another disadvantage, namely, if the frequency of the loop length in either a row of loops or a direction transverse thereto corresponds to the frequency of twist, which does occur as a heather yarn is used in a multiplicity of fabrics having different pile height, then the same color can be present at the top of such loops to form a streak in the loop row direction or a line of loops running in the transverse direction to form a chevron in the loop transverse direction.

U.S. Pat. No. 3,724,199 to Armstrong, discloses the different method of making a continuous filament heather yarn, comprising simultaneously drawing side-by-side continuous filament yarns having different dye receptivity, which is followed by an intermingling step to produce a plied yarn. But this process, too, is preferably carried out with a final twisting step and indeed the conventional ring and traveler mechanism 52 shown in the drawing is a twisting device, whereby this process introduces the same disadvantage as does the twisting disclosed in U.S. Pat. No. 3,534,540.

British Patent No. 1,166,247 discloses the making of continuous filament heather yarn by a simultaneous drawing of the component continuous filament yarns except that the next step is either intermingling or twisting. When twisting is the next step, the process is similar to that of U.S. Pat. No. 3,724,199; when intermingling is the next step, the process is similar to that of U.S. Pat. No. 3,534,540. South African Patent Publication 73/3977 discloses a later development to the same assignee as British Patent No. 1,166,247, wherein the continuous filament heather yarn is made by both drawing and crimping the component yarns together, and this is followed by a pair of intermingling steps. In the first intermingling step, the filaments are intermingled within each yarn, and in the second step the two intermingled yarns are brought together for entanglement with one another. In each intermingling step the yarn is under tension as it passed therethrough. In terms of heather, the result of this process is a heather yarn which is too bold, as in U.S. Pat. No. 3,534,540, because the intermingling of the feed yarns prevents them from being blended together.

U.S. Pat. No. 3,846,968 discloses a heather yarn formed eiter from continuous filaments or staple fiber yarn wherein the component yarns are simultaneously passed under tension through a jet intermingling device which exposes the combination of yarns to pulsating air forces which combine the yarns into a single heather yarn comprising high bulk regions alternating with compacted regions, the yarns in the compacted regions being a blend of the yarns making up the heather yarn. The compact regions are apparently to take the place of twist in holding the component yarns together but unfortunately as in the case of twist, the compact regions are regularly spaced which is a disadvantage if their regular spacing corresponds to the amplitude of the loop in a pile fabric.

U.S. Pat. No. 3,811,263 discloses the making of a heather yarn using trilobal cross-section continuous filament especially to accentuate the bold appearance effect of the yarn.

SUMMARY OF THE INVENTION

The present invention provides a continuous filament heather yarn that overcomes the foregoing described disadvantages of prior continuous filaments in heather yarns in that the heather yarn of the present invention provides not only the colors of the component yarns making up the heather yarn but also provides various blends of such colors, with the areas of these different colors being randomly interspersed along the heather yarns whereby a pile fabric prepared therefrom has the appearance of individual color "points", which are the component yarn colors, dispersed in a heathered background which mutes the color "points" and consists of various colors arising from various degrees of blending of the component yarns making up the heather yarn. More specifically, the continuous filament heather yarn of the present invention is composed of a plurality of crimped continuous filament yarns of different color and/or dye receptivity and substantially free of twist, said crimped continuous filament yarns in said heather yarn being substantially free of twist relative to each other, each said crimped continuous filament yarns in said heather yarn comprising a plurality of continuous filaments which are yarn-to-yarn randomly intermingled to form yarn-to-yarn blended areas of random length of said filaments randomly interspersed between yarn-to-yarn unblended areas of random length of said filaments, said heather yarn being characterized by a percent flash of 25 to 75 and average flash length of 3.9 to 16.5 cm and having a total denier of at least 400. The yarn-to-yarn blended areas hold the crimped continuous filament yarns together to form the heather yarn, and the distribution of these areas among the unblended areas as well as the lengths and proportions of the latter enables the heather yarn of the present invention to be made into a pile fabric which is substantially free of noticeable streaks and chevrons, and which is characterized by the colors of said crimped continuous filament yarns being visible but muted in appearance in said pile fabric.

The continuous filament heather yarn of the present invention is made by the process comprising tensioning a plurality of crimped continuous filament yarns of different color and/or dye receptivity and having a total denier of at least 400 to straighten the crimp of the filaments within each said yarns, feeding the yarns under tension and in contiguous relationship into a jet intermingling zone at a slower withdrawal rate from said zone than feed rate to said zone, and randomly jet intermingling the filaments of said yarns from yarn-to-yarn within said jet intermingling zone.

DETAILED DESCRIPTION OF THE PRESENT INVENTION

First a representative process of the present invention will be described and then the heather yarn product of the present invention will be described.

Figure 1:
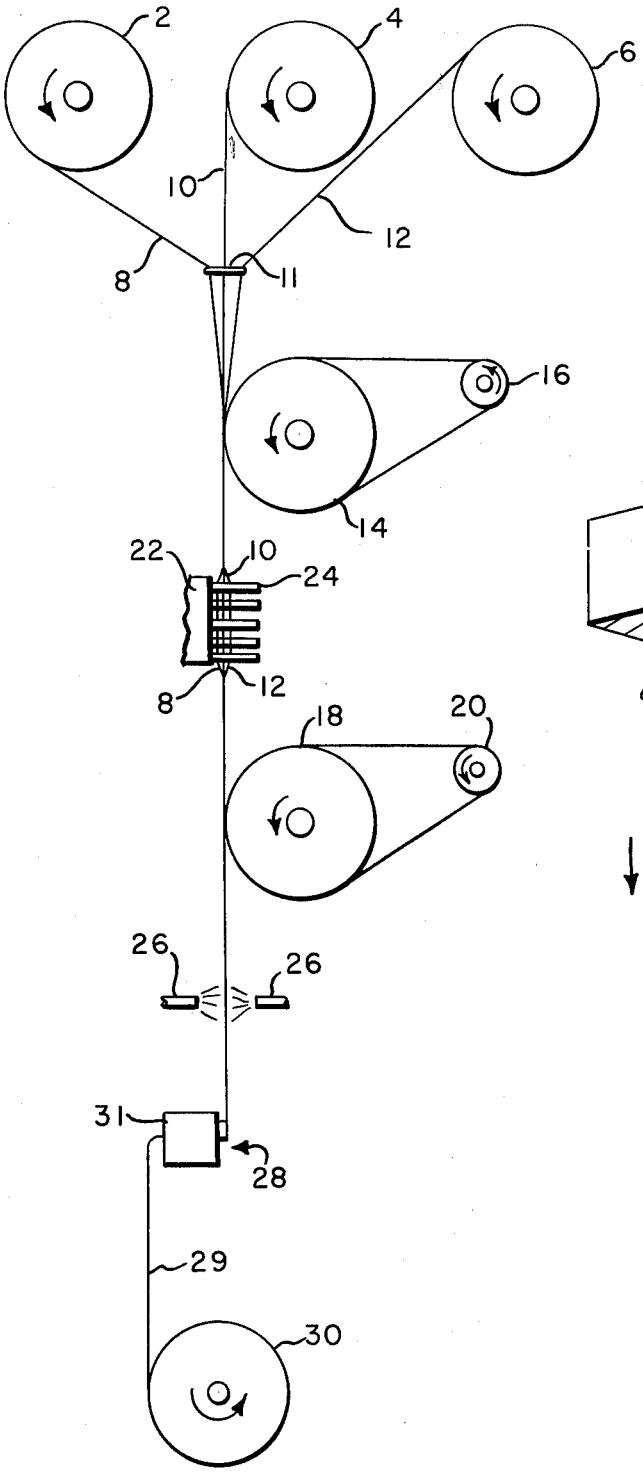
FIG. 1 is a schematic elevational view of a process of the present invention for making heather yarn of the present invention.

In FIG. 1 is shown three bobbins, 2, 4, and 6, supplying crimped continuous filament yarns 8, 10, and 12 which have different color and/or dye receptivity through a convergence guide 11 and then to a pair of draw rolls 14 and 18 and associated separator rolls 16 and 20. The yarns 8, 10, and 12 are supplied side-by-side to draw roll 14, whereupon the yarns wind first around draw roll 14 and separator roll 16 in side-by-side relationship and then around draw roll 18 and separator roll 20 for a sufficient number of wraps in side-by-side relationship that there is no slippage of the yarns on the roll surfaces. Draw roll 18 and separator roll 20 are operated at a faster surface speed than that of draw roll 14 and separator roll 16 so that the continuous filaments of each of the yarns 8, 10, and 12 are tensioned in passing from roll 14 to roll 18. This tensioning of the yarns "straightens-out" the crimp in the feed yarns 8, 10, and 12 which has the effect of parallelizing the filaments of the yarns and removing entanglement between the filaments within each yarn. The draw roll 18 and separator roll 20 do not operate at such a high relative speed over draw roll 14 and separator roll 16 as to effect drawing of the continuous filaments of the yarns because this would defeat the purpose of the filament crimp present in the feed yarns 8, 10, and 12.

Between draw rolls 14 and 16 is a snubbing device 22 consisting of a line of snubbing pins 24 through which the yarns 8, 10, and 12 interweave so as to further disentangle the continuous filaments of each of the yarns. FIG. 1 shows the individuality of each of the yarns 8, 10, and 12 as they pass through the snubbing device 22. Ideally, it is desired that each of the continuous filaments of each of these yarns also possesses this individuality, i.e., parallelism and disentangled relationship with adjacent filaments, as the yarns pass through the snubbing device. This parallelized relationship remains for the yarns in filaments thereof as they pass around the draw roll 18 and separator roll 20.

From draw roll 18, the yarns 8, 10, and 12 in side-by-side parallel relationship pass through a water applicator such as water sprays supplied by nozzles 26 which wets the filaments of the yarns for treatment in the subsequent jet intermingling zone 28 which will be described in greater detail hereinafter, and finally the heather yarn 29 formed by the intermingled yarns is wound up on roll 30.

In the jet-intermingling zone 28, the continuous filaments are yarn-to-yarn randomly jet-intermingled to form yarn-to-yarn blended areas of random length of the filaments randomly interspersed between yarn-to-yarn unblended areas of random length of the filaments, these areas being so proportioned that pile fabrics formed from the yarn are free from noticeable streaks or chevrons and present a pleasing coloration (when the yarns are dyed if not already colored) consisting of the colors of the individual yarns muted in a background of blends of the colors.

Figure 2:
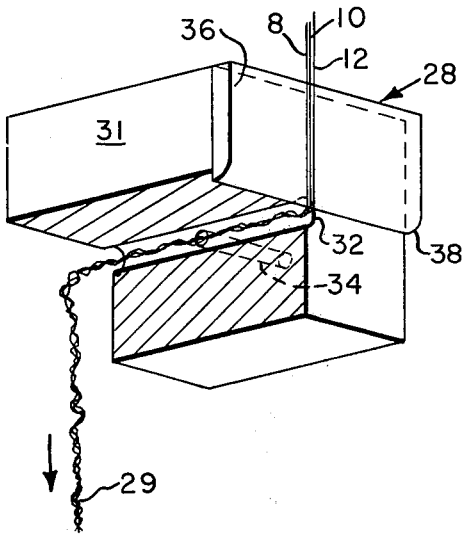
FIg. 2 is a perspective cut-away view of one embodiment of jet intermingling device used in the process of the present invention.

The jet intermingling zone 28 is shown in greater detail in FIG. 2. The zone 28 comprises a jet body 31, through which is formed a yarn passageway 32 and a fluid passageway 34 extending perpendicularly from the yarn passageway 32 to the exterior of the jet body. A yarn gate 36 is positioned covering the portion of the entry side of the yarn passageway 32, the gate 36 having a smooth surface over which rides the parallelized yarns 8, 10, and 12 entering the jet body in contiguous relationship. The gate 36 also has a curved surface 38 which smoothly leads the yarns 8, 10, and 12 into the yarn passageway.

Within the yarn passageway, a pressurized fluid jet at about ambient temperature and of sufficient force is applied through the fluid passageway 34 to provide the random intermingling of yarns 8, 10, and 12 just described. The restriction of the entrance to the yarn passageway by gate 36 has the effect that the fluid supplied by orifice 34 which intermingles the filaments of the yarns 8, 10, and 12 also primarily exits the yarn passageway through the opposite side of the jet body. The effect of this concurrent flow of fluid with the movement of yarn within the yarn passageway is that the fluid also serves to forward the yarns from draw roll 18 and maintain the yarns under tension up until the time of jet intermingling. The intermingled heather yarn 29 just exiting the jet body as shown in FIG. 2 forms a "rooster tail" relative to the jet body 31. The "rooster tail" is a region in which the filaments of the yarns are still splayed from the pressurized fluid jet, whereby intermingling is still occurring. The heather yarn 29 is also traveling at a slower speed than the yarns 8, 10, and 12 entering the jet-intermingling zone and is taken up by windup roll 30. It is critical in the process of the present invention that the surface speed of windup roll 30 be less than the surface speed of draw roll 18, whereby the yarns 8, 10, and 12 are free of tension during jet intermingling, otherwise the random intermingling of filaments will not occur and the results will be a heather yarn that is too bold as obtained in the prior art. For example, when the windup speed is equal to or greater than the surface speed of draw roll 18, the resultant heather yarn is characterized by a percent flash of greater than 85.

In greater detail, the number of feed yarns can vary from the three yarns shown in FIG. 1; at least two crimped continuous filament yarns are required, but a greater number such as four or more crimped continuous filament yarns can be used. The crimped continuous filament feed yarns can be made of continuous filament yarns processed by any of the well-known crimping methods to produce a crimp in the yarn, such as gear crimping, stuffer box crimping, and hot jet crimping which is preferred and produces random curvilinear crimp in the yarn. The yarns are preferably heat set. Alternatively, the feed yarn can be crimped by being of bicomponent filaments which supply the crimp by differential shrinkage. In any event, the crimp-forming process, particularly in the case of hot jet and stuffer box crimping of the feed yarn, also entangles the filaments within each yarn. This entanglement must be removed, otherwise the desired yarn-to-yarn filament blending does not occur in the intermingling zone 28. This entanglement is removed by tensioning (not drawing) the feed yarns with or without the help of a snubbing device. Examples of suitable bulked continuous filament yarns are those described in Example XXII of Breen et al., U.S. Pat. No. 3,186,155. Continuous filament yarn that is ambient air jet bulked as in accordance with Breen, U.S. Pat. No. 2,783,609, to produce crunodal loops in the yarn is not useful as feed yarn in the present invention because the looping of the filaments around one another is generally so complete that the filaments cannot be disentangled and parallelized by mere tensioning with or without intermediate snubbing which is convenient for continuous processing. Preferably, each of the feed yarns used in the present invention is characterized by the same kind of crimp. Also, preferably, the filaments of each feed yarns has at least 4 crimps per 2.54 cm as determined by the test method disclosed in Horn and Nelson, U.S. Pat. No. 3,611,698. The crimp of the feed yarns supplies high bulk to the heather yarn of the present invention.

The total denier of the feed yarns is at least 400 since the heather yarns of the present invention are primarily intended for use in tufted and woven constructions such as is characterized by upholstery and carpet. Generally the denier per filament of each yarn will range from 4 to 25. The proportion of each yarn fed to the process for making the heather yarn of the present invention can vary with the heather result desired.

While no drawing of the yarns occur between draw rolls 14 and 18, the greater surface speed of draw roll 18 over draw roll 14 does exert tension on the yarns which effects the disentanglement and parallelizing hereinbefore described. Generally, the degree of tension exerted will be from 0.5 to 1.25 grams per denier, preferably 0.75 to 1.1. Other methods of tensioning the feed yarns, such as the use of spaced pairs of pinch rolls, can be used.

The degree of snubbing required, if any, will depend on the degree of entanglement that is present in the feed yarns and not removed by mere tensioning between draw rolls 14 and 18 alone. The number of snubbing pins can range from 2 to 10 with from 3 to 7 being preferred.

The disentangled parallelized crimped continuous filament yarns leaving draw roll 18 preferably are in such condition that the individual filaments of the yarns can be separated from one another with at most little disturbance of the remainder of the yarn. The relationship between filaments of a continuous filament yarn can be described in terms of coherency factor as described in Bunting and Nelson, U.S. Pat. No. 2,985,995. Typically, the crimped yarns fed to draw roll 14 will have a coherency factor greater than 35. In the present invention, the lower the coherency factor of the feed yarns leaving roll 18, the better is the heather result. Preferably, the removal of the disentanglement of the feed yarns accomplished by the draw rolls 14 and 18, with the help of snubbing, if necessary, is such that the feed yarns leaving roll 18 have a coherency factor (average of the coherency factor of each feed yarn) of no greater than 5.

The wetting of the feed yarns by sprays 26 increases the efficiency of the intermingling accomplished in the jet entangled zone, in that for all other conditions remaining equal, greater intermingling is achieved with the use of the water spray. Any liquid that increases the intermingling efficiency can be used.

With respect to the jet intermingling zone 28, the overfeed preferably exceeds the withdrawal rate from the zone by at least 4%. An overfeed of greater than 30% is not desired. Within this range, the greater the overfeed, the greater is the yarn-to-yarn intermingling. The preferred range of overfeed is from 6 to 25%. While the yarns 8, 10, and 12 are shown to enter and exit the jet intermingling zone 28 at right angles, the yarns can also follow a path which forms a different angle or no angle at all with respect to the line of entry and exit to the jet intermingling zone. The important feature, however, is that the windup roll is operated at a slower speed than the draw roll 18 so as to provide the percent overfeed desired. Also important is the forwarding action of the jet intermingling zone on the yarn since this also permits operation at the overfeed desired. This also permits the filaments to splay and thereby continue intermingling just outside of the exit end of the yarn passageway 32 regardless of the angle of the exiting yarn 29 to the jet body 31. The tension exerted on the yarns leaving draw roll 18 by the forwarding action of the jet intermingling zone is less than the tension exerted between draw rolls 14 and 18 but is sufficient to strip the yarns off of draw roll 18 to prevent back wrap and to provide the feed to the jet intermingling zone. If the tension exerted between draw rolls 14 and 18 on the yarns were present on the yarns in the jet intermingling zone, little or no intermingling of filaments would occur.

The yarn gate is positioned so that it covers from 30 to 80% of the yarn passageway entry opening, preferably 45 to 60%. The preferred intermingling fluid is a gas, preferably air. Generally the air will be supplied at a pressure of from 7 to 14 kilograms per square centimeter, preferably from 7.7 to 12.3 kilograms per square centimeter.

The exposure of the disentangled continuous filament yarns contiguous to one another within the jet body 31 to the turbulent fluid combined with the sudden release of the tension on the yarns provides the novel random intermingling result hereinbefore described.

Since, the feed yarns entering the jet intermingling zone are already crimped, the jet is not required to do any crimping of such yarns, but only intermingle them. If the jet were also required to crimp the yarns, the crimp would be less, giving a less bulky heather yarn product, because of the higher denier of the yarns being crimped together rather than separately, and the yarn-to-yarn filament intermingling would also be less.

Both the feed yarns and the heather yarn made therefrom are substantially free of twist. No twist is preferred but some small amount of twist may occur in the handling of the yarns. Preferably, both the feed yarns and the heather yarn have no greater than ¼ turn of twist per 2.54 cm and more preferably no greater than ⅛ turn per 2.54 cm. The jet intermingling step occasionally may cause one feed yarn to cross over another feed yarn to resemble twist but this is not considered twist because of the randomness at which it occurs.

The process shown in FIG. 1 can be varied provided that the critical steps of disentangling the continuous filaments of the crimped continuous filament feed yarns is done and overfeed is established to the jet intermingling zone. For example, the tensioning done for disentangling purposes can be done on feed yarns separately and in a separate operation from the jet intermingling, and the tensioned yarn can be wound onto packages which are later fed to the jet intermingling zone. The preferred overfeeds to the jet intermingling zone are 4 to 15% and 6 to 25% when the tensioning and jet intermingling are done on an interupted basis or on an in-line basis, respectively. A pair of nip rolls can be used to tension the feed to wind up roll 30.

The component yarns making up the heather yarn of the present invention can be any synthetic polymer filaments, provided that they are separately colored or separately colorable by different dye receptivity. The filaments of one component yarn can be the same or different polymer from the filaments of another component yarn. Different dye receptivity can be established by the functional groups, such as end groups of the polymer as is well known in the art. The preferred heather yarns of the present invention are composed of all polyamide or all polyester crimped continuous filament feed yarns.

Figure 3:
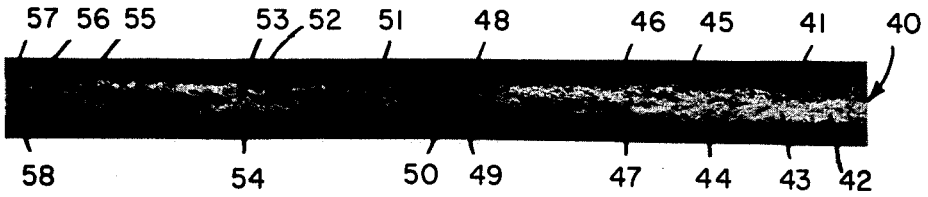
FIG. 3 is a photographic enlargement of about 2.4 X of one embodiment of a heather yarn of the present invention.

To further describe the heather yarn product of the present invention, FIG. 3 is a photographic enlargement of about a nine cm length of such yarn indicated as yarn 40. This yarn was made in apparatus similar to that shown in FIG. 1 using an 8.4% overfeed to the jet-intermingling zone. This yarn was made from three crimped continuous filament yarns which had different dye receptivity to produce the following colors: dark blue, very light blue (almost white), and yellow. These yarns are integrated without twist into the heather yarn of the present invention by the process of the present invention. The nine cm length of yarn in FIG. 3 has the following heather appearance:

| Lead Line Number | Heather Appearance |
|---|---|
| 41 | Strip of yellow |
| 42 | Strip of dark blue |
| 43 | Blotch of light blue |
| 44 | Strip of medium to dark blue |
| 45 | Narrow strip of yellow |
| 46 | Blotch of yellow |
| 47 | Blotch of greenish blue |
| 48,49 | Narrow strips of yellow |
| 50 | Strip of greenish blue |
| 51 | Blotch of yellow to greenish yellow |
| 52 | Narrow strip of light blue |
| 53 | Narrow strip of yellow |
| 54 | Narrow strip of dark blue |
| 55 | Blotch of light greenish blue |
| 56 | Blotch of yellow |
| 57 | Strip of light greenish blue |
| 58 | Strip of dark blue |

The regions where the component yarn colors, dark blue, light blue, and yellow predominate are randomly interspersed and are of random, short length. The strips of colors noted in the yarn are either parallel to or at an angle with the axis of the yarn and do not give a twist appearance. The portions denoted as blotches are too short to be called strips and may cover the entire width of the yarn from the side being observed.

From the foregoing description of the yarn it is apparent that no color pattern repeats itself with any regularity that could show up as a streak or chevron in a fabric.

Figure 4:
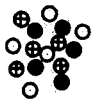
FIGS. 4, 5, 6, 7, and 8 are schematic representation of some of the different cross sections of a heather yarn of the present invention.
Figure 5:
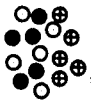
Figure 6:
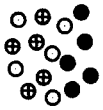
Figure 7:
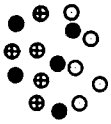
Figure 8:
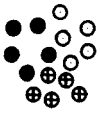

The different and random colored appearance of the heather yarn is a result of the different and random degree of blending of the filaments occurring in the jet-intermingling zone. FIGS. 4, 5, 6, 7, and 8 show schematically, typical different cross sectional distributions of yarn components of heather yarns of the present invention. In these figures, the heather yarn is made from three feed yarns and for simplicity and clarity, each yarn now forming a component of the heather yarn consists of five filaments. Each component yarn is of a different color. The open circles represent filaments of one yarn of one color. The darkened circles represent filaments of the second yarn but of a different color, and the circles with a + through them represent filaments of the third yarn of still a different color. FIG. 4 shows a random blend of the different color filaments, which blend would have the appearance of the blend of about equal amounts of the three colors involved. FIG. 5 shows the combination of a random blend of two of the three colored groups of filaments, with the third group being concentrated on the right side of the yarn. The colored appearance of this yarn will depend on the side of observation. When the yarn of FIG. 5 is viewed from the right hand side, the color of a single component yarn predominates whereas when the yarn is viewed from the left hand side a color blend of the two other component yarns predominates. On the other hand, if the yarn is viewed from the top or bottom, the observer sees both a color blend and a true color of a yarn component of the heather yarn. The same relationship is true for the yarn cross sections shown in FIGS. 6 and 7 except that the blend combinations of filaments are different. FIG. 8 shows a cross section of an area wherein there is no blending of filaments from yarn-to-yarn and the color of each of the component yarns is viewed from the right hand side, the color of a single component yarn predominates whereas when the yarn is viewed from the left hand side a color blend of the two other component yarns predominates. On the other hand, if the yarn is viewed from the top or bottom, the observer sees both a color blend and a true color of a yarn component of the heather yarn. The same relationship is true for the yarn cross sections shown in FIGS. 6 and 7 except that the blend combinations of filaments are different. FIG. 8 shows a cross section of an area wherein there is no blending of filaments from yarn-to-yarn and the color of each of the component yarns is visible in the heather yarn, depending on which side the yarn is viewed.

Figure 9:
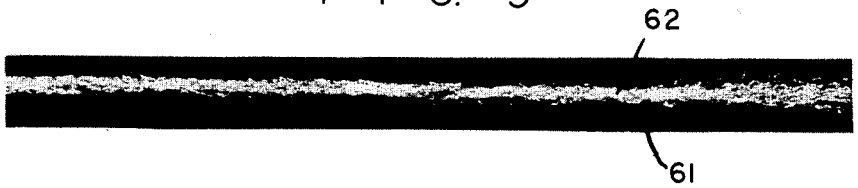
FIG. 9 is a photographic enlargement of about 2.4 X of a continuous filament heather yarn in which the two yarn components are substantially in side-by-side registration with one another, which yarn is outside the scope of the present invention.
Figure 10:
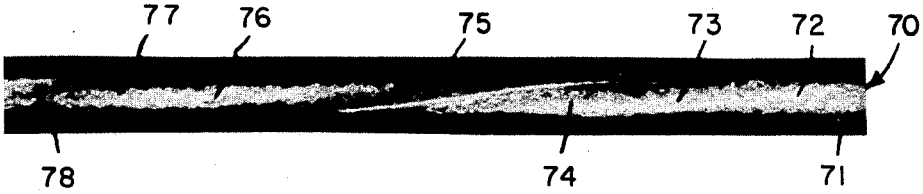
FIG. 10 is a photographic enlargement of about 2.4 X of another continuous filament heather yarn in which the three yarn components are twisted together, this yarn also being outside the scope of the present invention.

FIGS. 9 and 10 show similar lengths of continuous filament heather yarns which are not yarns of the present invention but which are shown herein for comparison purposes. More specifically, FIG. 9 shows a length of yarn 60 in which the yellow and the blue yarn color components 61 and 62, respectively, are more or less side-by-side with possibly a slight degree of twist, for example, one turn per 20 cm. FIG. 10 shows a similar length of yarn 70 but of the same three color components as in yarn 40 of FIG. 3 in which the side-by-side yarn registry is somewhat broken by a greater degree of twist of the yarn, i.e., about ¾ turn per 2.54 cm wherein the following colors are visible in helical strips (moving from right to left): 71 — yellow, 72 — dark blue to light blue, 73 — light blue, 74 — greenish yellow, 75 — yellow, 76 — light blue to dark blue, 77 — dark blue, and 78 — yellow to greenish yellow. The monofilament-appearing strand in FIG. 10 is an anti-static yarn twisted around the heather yarn. In the case of FIG. 9, the side-by-side registration of the two yarn components of the heather yarn produces a pile fabric which is too bold in the sense that primarily it is the colors of the yarn components that are visible. The same is true for the three component yarn of FIG. 10, with the twist introducing the additional deficiency of a potential for streakiness and chevroning in fabrics.

Rather than identify heather yarns of the present invention by observation of color distribution only, which does give an indication of the random intermingling of the different color filaments, a method has been developed which involves scanning a length of the yarn with a light source, detecting the light reflected from the yarn with a photocell, and converting this detected light to a meaningful parameter, in this case called percent flashes. A "flash" is the light that is detected from the reflection from the lightest color component yarn visible in the heather yarn. If the feed yarn components have no significant physical property differences which affect blending or reflectance, any one can be dyed in order to identify unblended flash areas. Since the undyed component has the lightest color, usually white, in the heather test yarn, this yarn component generally reflects the most light. The reflectance of dyed component yarn should be about 10% and of the undyed component, about 40% as determined by reflectance colorimetry. If more than two component yarns are present in the heather yarn, only one of the yarns is dyed.

The voltage output of the photocell which varies with the intensity of the reflected light from the heather yarn is convertible to an identification of an area of the lightest color yarn component(s) in the heather yarn. The yarn can be characterized by percent flashes which is 100X the length of the "flashes" (flash length) in the yarn divided by the total yarn length tested. The terms "flash" and "flash area" while photoelectric measured properties of the heather yarn can also be used to describe the structure of the corresponding areas of the heather yarn itself since an area that reflects the most light is also mainly a yarn-to-yarn unblended area.

In greater detail, the voltage output of the photocell can be supplied to a digital computer which counts only the voltage output corresponding to reflected light from white yarn as a flash. The threshold voltage over which the photocell output is counted as a flash is approximately the arithmetic average of the entire voltage output obtained on a heather yarn having the structural characteristics of the heather yarn of the present invention, i.e., free of twist, and blended and unblended areas. This approximate threshold value is then adjusted to the actual threshold value used in the test by testing two heather yarns of the structural characteristics of the heather yarn of this invention but processed slightly differently, such as by using different percent overfeeds in the jet intermingling zone, so as to produce different heathers in the two yarns. The threshold voltage value is adjusted to the voltage that produces the maximum difference in the percent flash results for these two yarns, and this is the threshold voltage value at which the heather yarns are thereafter tested. Adjustment of the threshold voltage from that which corresponds to the arithmetic average to that which gives the maximum difference in percent flash reading has the effect of adjusting the test equipment to its maximum sensitivity. While lengths of white yarn appearing in the heather yarn can be tested which are shorter than 3.8 centimeters, these lengths should be excluded from the computer read out information since flashes which are shorter than 3.8 cm are not harmful to streaking and chevroning in a pile fabric and can be considered as "noise" in the computer read out. The test length of yarn can be 25.40 meters. This length of yarn is run past an illumination source such as incandescent lamp, and the light reflected at an angle of 90° from the direction the light is received by the yarn from the light source is detected by a photocell that is sensitive to the reflected light. The computer counts the total number of flashes and flash lengths in the length of yarn tested. Operating the test in accordance with the parameters set forth in this paragraph including the exclusion of flash lengths shorter than 3.8 cm and with the voltage threshold that provides maximum sensitivity, we have found that when the percent flashes for the heather yarn is from 25 to 75 percent and the average flash length is from 3.9 to 16.5 cm, preferably 5.1 to 10.2 cm, the heather yarn has the desired yarn structure of yarn-to-yarn blended and unblended areas hereinbefore set forth, which gives a heather that is neither too bold nor too uniform in color in order to produce pile fabric having a muted multicolor appearance. Percent flash and average flash length can also be determined by visual examination of the heather yarn, but this is much more tedious than the machine measurement just described.

Examples of the present invention in which parts and percent are by weight unless otherwise indicated are as follows:

EXAMPLE 1

Three component yarns for the heather yarn were used. One yarn was 1225 denier polyamide cationic-dyeable yarn having a denier per filament of 19 and coherency factor of 47. The second yarn was 1225 denier polyamide low amine end acid-dyeable yarn having a denier per filament of 19 and coherency factor of 38. The third yarn was 1245 denier polyamide high amine end deep acid-dyeable yarn having a denier per filament of 15 and coherency factor of 51. Each yarn was previously hot jet crimped by the process of Example XXII of U.S. Pat. No. 3,186,155. Apparatus to make the heather yarn was similar to that shown in FIG. 1. The coherency factors for the yarns leaving draw roll 18 for the jet intermingling zone was 3.5, 4.9, and 3.0, respectively. The yarn passageway 32 in the jet intermingling zone 28 had a length of 25.4 millimeters and diameter of 3.18 millimeters. The fluid orifice had a diameter of 2.36 millimeters. The fluid used was air at a pressure of 10.5 kilograms per square centimeter and a temperature of 25° C and flow rate of 0.51 cubic meters per minute. The yarn feed speed to the jet intermingling zone was 682 meters per minute from draw roller 18 which exerted a pull out tension on the three feed yarns of one gram per denier. The snubbing device had five snubbing pins. Water was applied to the yarn at the rate of 0.18 milliliters per gram of yarn. The overfeed of the yarn to the jet intermingling zone was 15.07 percent and the winding tension exerted by the windup roll was 0.05 gram per denier. The resultant heather yarn was characterized by a percent flash of 44 and average flash length of 7.14 cm.

EXAMPLE 2

The process conditions for this example were the same as in Example 1 except that only the cationic dyeable yarn and deep dyeable acid dyeable yarn were used and the overfeed to the jet intermingling zone was reduced to 13.33 percent. The resultant heather yarn had a percent flash of 34.9 and average flash length of 6.45 cm.

What is claimed is:

1. A process for making a continuous filament heather yarn, comprising a. subjecting a plurality of crimped continuous filament yarns of different color and/or dye receptivity and having a total denier of at least 400 to a tension of from 0.5 to 1.25 grams per denier to straighten the crimp of the filaments within each of said yarns and to disentangle and parallelize the filaments, b. feeding said yarns under tension and in contiguous relationship into a jet intermingling zone, c. randomly jet intermingling the filaments of said yarns from yarn-to-yarn, and d. withdrawing the intermingled yarn from said zone at a rate which is 4 to 30% less than the feed rate of the yarns to said zone.

2. The process of claim 1 wherein the jet intermingling step involves applying a pressurized fluid jet to said yarns and, the pressurized jet also forwarding the resultant heather yarn thereby providing the tension for the yarns fed to the jet intermingling zone.

3. The process of claim 2 wherein the forwarded yarn forms a rooster tail region in which the filaments of the yarn are still splayed from the pressurized fluid jet and wherein intermingling is still occurring.

4. The process of claim 2 wherein the forwarding of the yarn by the pressurized jet is provided by covering a portion of the entry of a jet yarn passageway, wherein the pressurized fluid jet is applied to the yarns, with a yarn gate.

5. The process of claim 4 wherein the yarn gate covers from 30 to 80% of the yarn passageway entry.

6. The process of claim 1 wherein the withdrawal step is conducted so that the overfeed to the jet intermingling zone is from 6 to 25%.

7. The process of claim 1 wherein the yarns are tensioned to have an average coherency factor of no greater than 5 after the tensioning step.

8. The process of claim 1 and in addition the step of wetting the yarns with a liquid between the tensioning and feeding steps.

9. The process of claim 8 wherein the liquid is water.

10. The process of claim 1 wherein the crimp in the crimped continuous filament yarns is a random curvilinear crimp.

* * * * *